US012643726B2

(12) United States Patent
Doherty

(10) Patent No.: US 12,643,726 B2
(45) Date of Patent: Jun. 2, 2026

(54) BOTTLE PACKAGING

(71) Applicant: NIAGARA BOTTLING, LLC, Diamond Bar, CA (US)

(72) Inventor: Mark Doherty, Aliso Viejo, CA (US)

(73) Assignee: Niagara Bottling, LLC, Diamond Bar, CA (US)

( * ) Notice: Subject to any disclaimer, the term of this patent is extended or adjusted under 35 U.S.C. 154(b) by 8 days.

(21) Appl. No.: 18/429,063

(22) Filed: Jan. 31, 2024

(65) Prior Publication Data

US 2024/0253884 A1 Aug. 1, 2024

Related U.S. Application Data

(60) Provisional application No. 63/482,488, filed on Jan. 31, 2023.

(51) Int. Cl.
*B65D 71/70* (2006.01)

(52) U.S. Cl.
CPC ..... *B65D 71/70* (2013.01)

(58) Field of Classification Search
CPC ..... B65D 71/70; B65D 71/72
USPC ..... 206/158, 145–147, 200
See application file for complete search history.

(56) References Cited

U.S. PATENT DOCUMENTS 2,320,440 A * 6/1943 Kruea ..... B65D 71/406 215/396
2,337,243 A 12/1943 Hutaff, Jr.
2,386,101 A 10/1945 Firks et al.
2,397,708 A 4/1946 Ulbrich
2,407,529 A 9/1946 Bertram
2,420,191 A 5/1947 Ransom
2,442,636 A * 6/1948 Bertram ..... B65D 71/50 248/312
2,454,178 A * 11/1948 Howell ..... B65D 71/50 294/87.26
2,457,027 A * 12/1948 Bertram ..... B65D 71/50 294/103.1
3,232,422 A 2/1966 Whyte
(Continued)

FOREIGN PATENT DOCUMENTS

CN 215624021 U 1/2022
DE 2401077 A1 7/1975
(Continued)

OTHER PUBLICATIONS

International Search Report and Written Opinion for Application No. PCT/US2024/013840 dated Jul. 16, 2024 (14 pages).

*Primary Examiner* — Rafael A Ortiz
(74) *Attorney, Agent, or Firm* — Michael Best & Friedrich LLP

(57) ABSTRACT

A clip assembly for holding a bottle in a bottle pack includes a first sheet defining an aperture having a larger diameter portion and a smaller diameter portion. The clip assembly also includes a second sheet defining an aperture having a larger diameter portion and a smaller diameter portion. The clip assembly further includes an adhesive positioned between a top surface of the first sheet and a bottom surface of the second sheet, the adhesive securing the first sheet to the second sheet. The bottle extends through the smaller diameter portion of the first sheet and the smaller diameter portion of the second sheet and is captured between the first sheet and the second sheet.

11 Claims, 15 Drawing Sheets

(56) References Cited

U.S. PATENT DOCUMENTS 3,285,410 A * 11/1966 Brunsing ..... B65D 71/50 53/48.5
3,653,504 A 4/1972 Saumsiegle
3,784,003 A 1/1974 Bolton
3,884,354 A * 5/1975 Guenther ..... B65D 71/50 206/427
4,550,824 A * 11/1985 Rhoads ..... B65D 71/504 206/150
4,798,286 A 1/1989 Muscanelli
5,311,994 A * 5/1994 Oliff ..... B65D 5/4279 206/427
5,314,224 A * 5/1994 Bates ..... B65D 71/46 294/87.2
5,485,914 A 1/1996 Martin
5,487,463 A * 1/1996 Harris ..... B65D 71/40 206/427
5,513,888 A 5/1996 Kirkland
5,682,982 A * 11/1997 Stonehouse ..... B65D 71/42 206/197
5,775,503 A * 7/1998 LeBras ..... B65D 71/46 206/427
6,082,532 A * 7/2000 Miess ..... B65D 71/44 206/199
D883,561 S 5/2020 Romano et al.
11,498,780 B2 11/2022 Parker et al.
2009/0045081 A1* 2/2009 Hamann ..... B65D 71/504 206/427
2022/0330724 A1* 10/2022 Chow ..... B65D 5/52

FOREIGN PATENT DOCUMENTS

DE 202005017329 U1 1/2006
EP 3757034 B1 * 7/2023 ..... B65D 71/44
FR 3115529 A1 12/2022
JP 49061847 A2 6/1974

* cited by examiner

BOTTLE PACKAGING

CROSS-REFERENCE TO RELATED APPLICATION

This application claims priority to U.S. Provisional Patent Application No. 63/482,488, filed Jan. 31, 2023, the entire contents of which are incorporated herein by reference.

FIELD OF THE INVENTION

The present invention relates to packaging for bottles. More specifically, the present invention relates to recyclable packaging for bottles.

BACKGROUND

Bottle packs often include shrink wrap to secure bottles in place. The shrink wrap typically may not be recycled and is instead thrown away. As such, it is advantageous to secure the bottles in place with a material that may be recycled.

SUMMARY

The present disclosure provides, in one aspect, a clip assembly for holding a bottle in a bottle pack. The clip assembly includes a first sheet defining an aperture having a larger diameter portion and a smaller diameter portion. The clip assembly also includes a second sheet defining an aperture having a larger diameter portion and a smaller diameter portion. The clip assembly further includes an adhesive positioned between a top surface of the first sheet and a bottom surface of the second sheet, the adhesive securing the first sheet to the second sheet. The bottle extends through the smaller diameter portion of the first sheet and the smaller diameter portion of the second sheet and is captured between the first sheet and the second sheet.

The present disclosure provides, in another aspect, a bottle pack including a plurality of bottles. Each bottle includes a neck defining a first diameter, a bell defining a second diameter, and a support ring defining a third diameter, the first diameter being smaller than the second diameter and the third diameter. The bottle pack also includes a clip assembly including a sheet defining a plurality of apertures, each aperture having a fourth diameter, each aperture receiving the neck of one of the bottles such that each bottle is captured by the clip assembly. The bottle pack further includes a band wrapped around the plurality of bottles. The fourth diameter is greater than the first diameter. The fourth diameter is smaller than the second diameter and the third diameter.

The present disclosure provides, in another aspect, a method of assembling a bottle pack. The bottle pack includes a plurality of bottles, a first sheet, and a second sheet, each bottle having a neck, the first sheet including a plurality of apertures each having a larger diameter portion and a smaller diameter portion, the second sheet including a plurality of apertures each having a larger diameter portion and a smaller diameter portion. The method includes inserting the neck of each bottle through a corresponding larger diameter portion of the first sheet. The method also includes moving the first sheet relative to the plurality of bottles such that the neck of each bottle is received in the corresponding smaller diameter portion of the first sheet. The method also includes inserting the neck of each bottle through a corresponding larger diameter portion of the second sheet. The method also includes moving the second sheet relative to the plurality of bottles and the first sheet such that the neck of each bottle is received in the corresponding smaller diameter portion of the second sheet. The method also includes applying an adhesive between a top surface of the first sheet and a bottom surface of the second sheet to couple the first sheet to the second sheet.

Other aspects of the disclosure will become apparent by consideration of the detailed description and accompanying drawings.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

DETAILED DESCRIPTION

Figure 1:
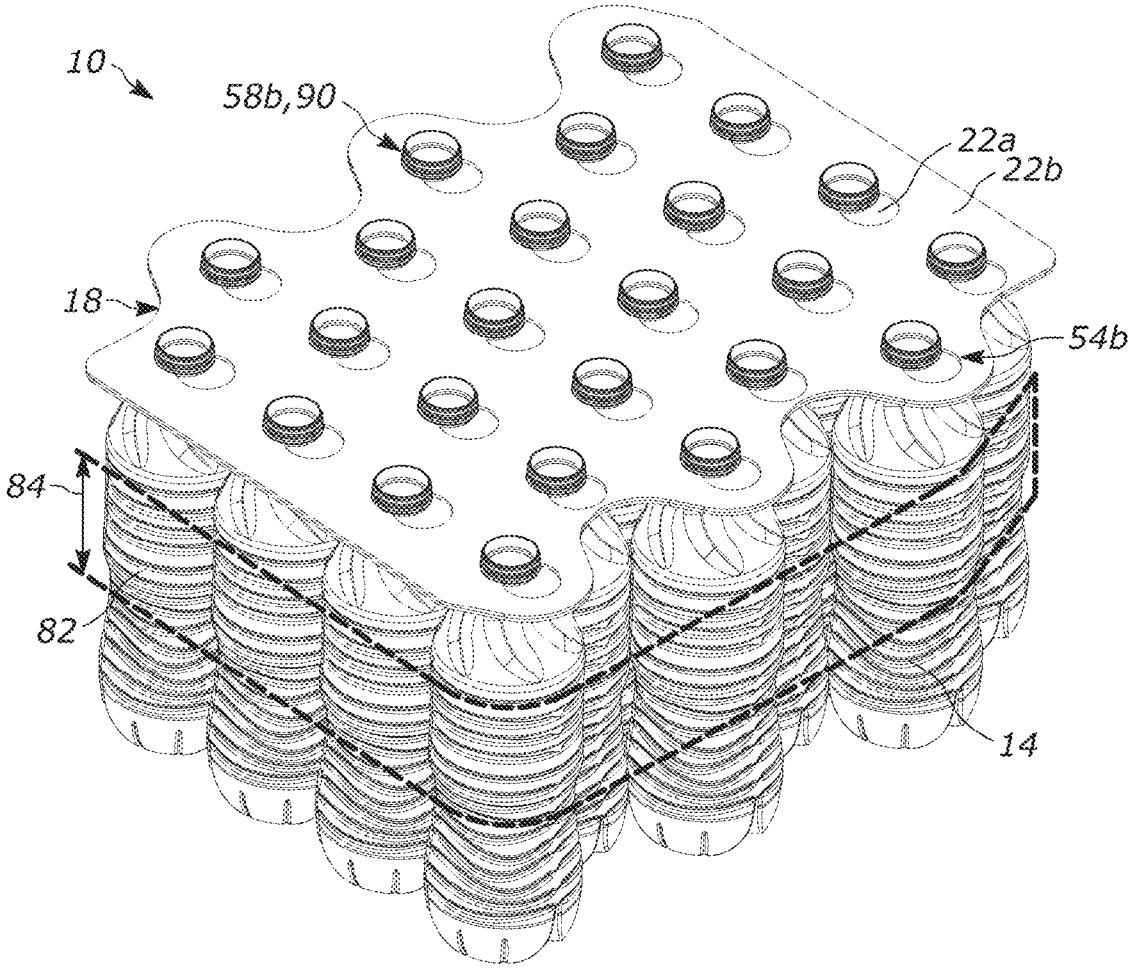
FIG. 1 is a perspective view of a bottle pack including a plurality of bottles and a clip assembly.

FIG. 1 illustrates a bottle pack 10 including a plurality of containers 14 (e.g., plastic bottles 14) and a clip assembly 18 coupled to the containers 14. The containers 14 illustrated in the figures are bottles 14, and further have an internal volume of approximately one half-liter (0.5 L). It should be appreciated that the bottles 14, and specifically 0.5 L bottles are provided for purposes of illustration and are not limiting. The clip assembly 18 can be used in conjunction with any type of suitable container or vessel, or any size of suitable bottle (e.g., 1 L, etc.) that benefits from being coupled to the clip assembly 18.

Figure 2:
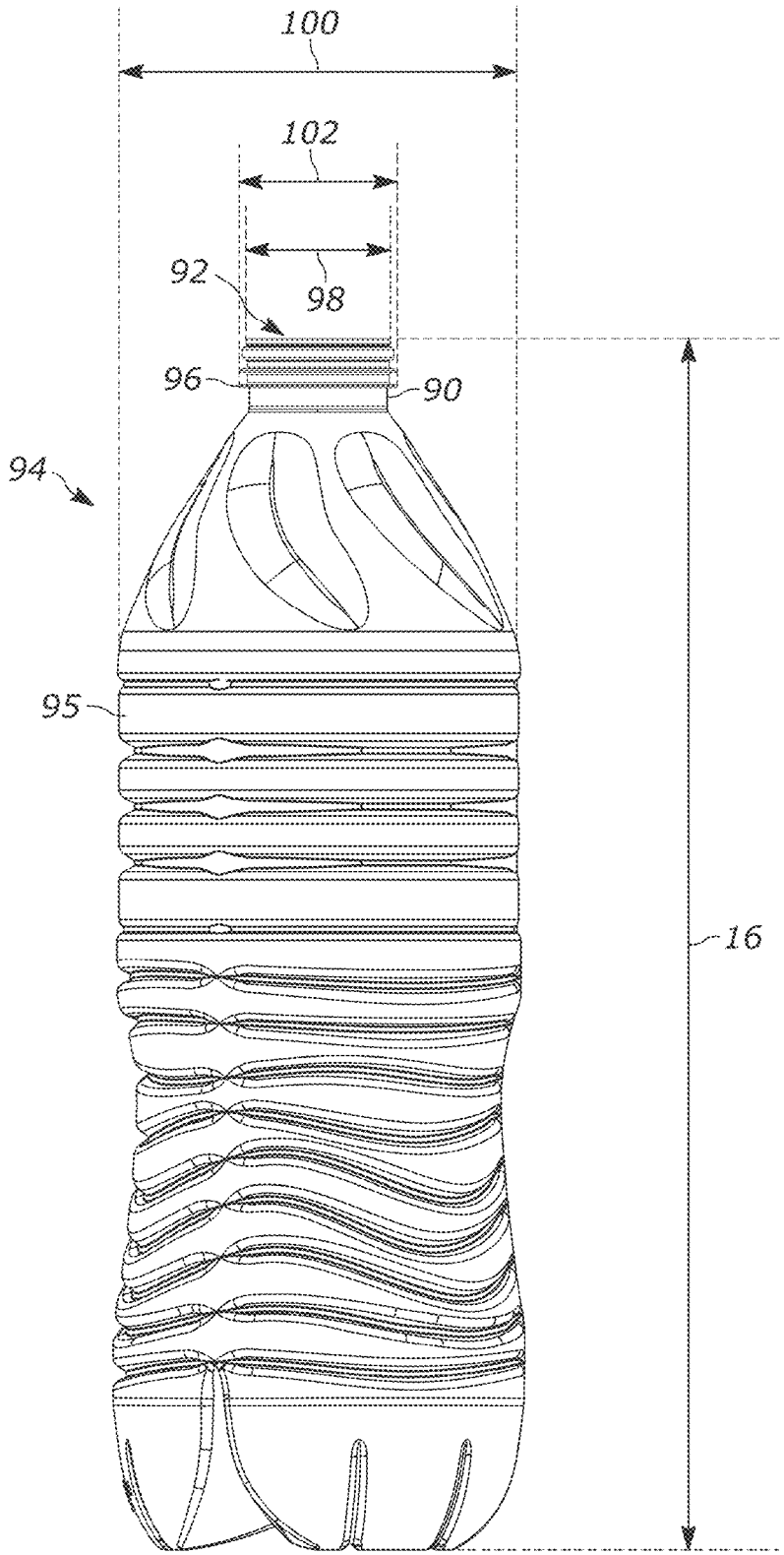
FIG. 2 is a side view of a bottle for use in the bottle pack of FIG. 1.

With reference to FIG. 2, the bottle 14 includes a neck 90 adjacent a bottle opening 92 and a bell 94 located on a side of the neck 90 opposite the bottle opening 92. The neck 90 has a first diameter or neck diameter 98 that is approximately constant along its entire axial extent. The bell 94 extends away from and radially outward from the neck 90 to a sidewall 95 of the bottle 14. The bell 94 defines a second diameter or bell diameter 100 at a radially largest region thereof, which is located opposite the neck 90. In the illustrated embodiment, the bell diameter 100 corresponds to a diameter of the sidewall 95, and further corresponds to a largest diameter of the bottle 14. The bottle 14 further includes a support ring 96 that protrudes radially outward from the neck 90. The support ring 96 has a third diameter or ring diameter 102 that is greater than the neck diameter 98 but smaller than the bell diameter 100. The bottle 14 is configured to threadably receive a cap, such as the cap 103 shown in FIG. 12. The cap 103 can have a fourth diameter or cap diameter 105 that may be approximately equal to the ring diameter 102. In other embodiments, the cap diameter 105 may be larger than the ring diameter 102 but smaller than the bell diameter 100.

The illustrated bottle pack 10 includes twenty-four bottles 14 arranged in six rows. In other embodiments, the bottle pack 10 may include fewer or more bottles 14 in any arrangement. The clip assembly 18 includes at least one sheet 22 (FIG. 3) made of a non-plastic material, such as a rigid and recyclable material (e.g., cardboard, fiberboard, or the like). In some embodiments, the sheet 22 may include strengthening features 24 (e.g., flutes, ridges, etc.) (FIGS. 15 and 16) to improve the rigidity of the sheet 22. The illustrated clip assembly 18 includes two sheets 22 including a first or bottom sheet 22*a* (FIGS. 5 and 9) and a second or top sheet 22*b*. The illustrated top sheet 22*b* is identical to the bottom sheet 22*a* but is oriented differently. In some embodiments, the bottom and top sheets 22*a*, 22*b* may not be identical.

Figure 3:
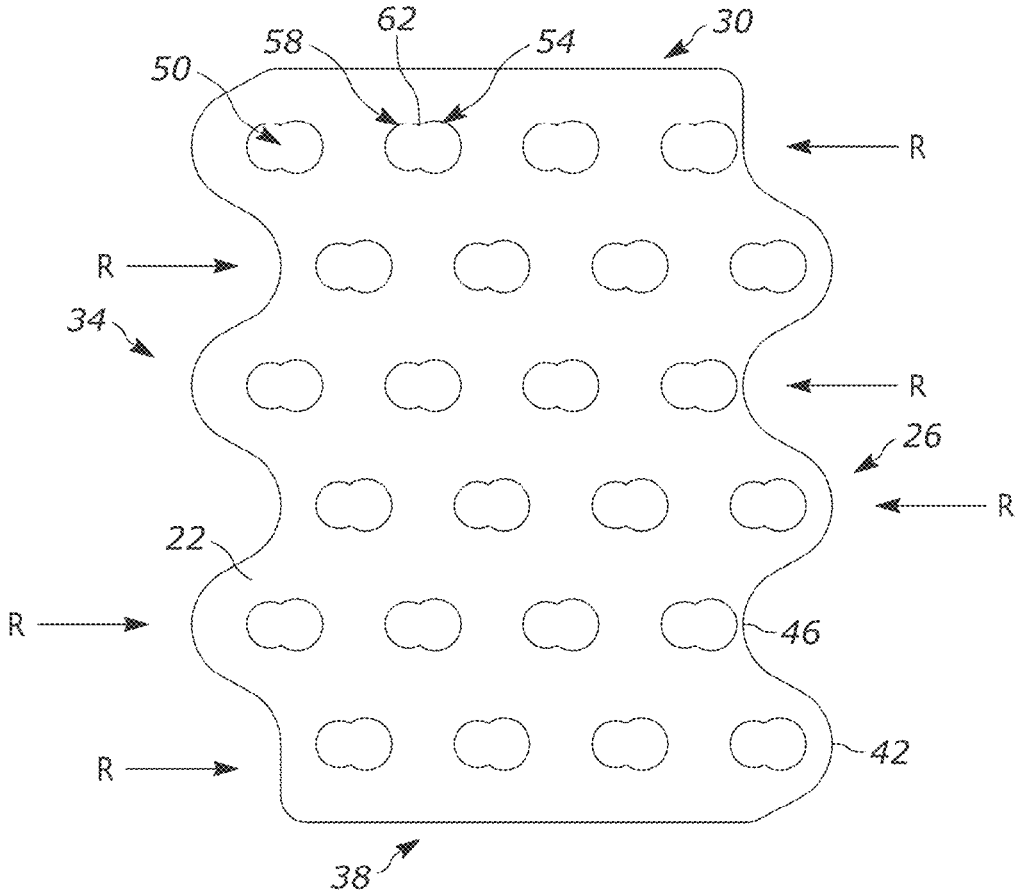
FIG. 3 is a top view of a first sheet of the clip assembly of FIG. 1.

With reference to FIG. 3, the sheet 22 includes a first side 26, a second side 30, a third side 34 opposite the first side 26, and a fourth side 38 opposite the second side 30. The illustrated first and third sides 26, 34 include undulations, which define an alternating series of extended portions 42 and recessed portions 46. The illustrated second and fourth sides 30, 38 are generally flat or straight. The sheet 22 further defines a plurality of apertures 50 that can receive the neck 90 of the bottle 14 as will be explained further herein. The apertures 50 are arranged in parallel rows R (six rows R in the illustrated embodiment) that extend between the first and third sides 26, 34. Adjacent apertures 50 within each row R are spaced apart from one another by approximately a largest diameter of the bottle 14 (i.e., the bell diameter 100 in the illustrated embodiment). In addition, the apertures 50 of adjacent rows R are offset from one another (i.e., the adjacent rows R are staggered) by approximately half of the largest diameter of the bottle 14 (i.e., the bell diameter 100 in the illustrated embodiment) in a direction extending between the first and third sides 26, 34. Stated another way, each aperture 50 is approximately aligned with a perimeter of two bottles 14 (e.g., a point where the two bottles 14 contact each other) in an adjacent row R. However, if the aperture 50 is the last aperture 50 in a respective row R, the aperture 50 can be aligned with the perimeter of one bottle 14. Accordingly, every other row R is aligned with each other. The arrangement and spacing of the apertures 50 allow the bottles 14 to be densely and efficiently spaced within the bottle pack 10 in an arrangement resembling a honeycomb configuration. Due to the offset configuration of adjacent rows R, one aperture 50 of each row R is located at least partially within the corresponding extended portion 42. Thus, the alternating extended portions 42 and recessed portions 46 of the first and third sides 26, 34 correspond to the offset or staggered arrangement of adjacent rows R while minimizing the amount of material forming the sheet 22. Specifically, as shown in FIG. 3, a first row of the rows R aligns with a first extended portion 42 of the third side 34 and with a first recessed portion 46 of the first side 26. A second row of the rows R, which is adjacent the first row, aligns with a first recessed portion 46 of the third side 34 and with a first extended portion 42 of the first side 26. A subsequent third row of the rows R aligns with a second extended portion 42 of the third side 34 and with a second recessed portion 46 of the first side 26.

Figure 4:
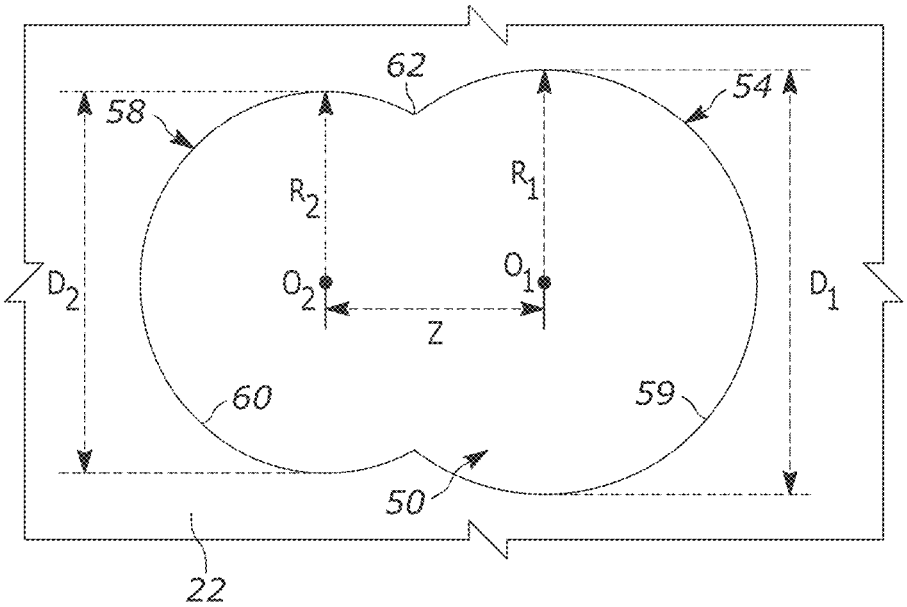
FIG. 4 is a top view of a portion of the first sheet of FIG. 3.

With reference to FIGS. 3 and 4, the apertures 50 each include a larger diameter portion 54 and a smaller diameter portion 58. The larger diameter portions 54 have a first diameter $D_1$ that is greater than a second diameter $D_2$ of the smaller diameter portions 58. The illustrated larger and smaller diameter portions 54, 58 resemble overlapping circles. The larger diameter portion 54 is defined by a curved first edge 59 that is shaped as a first major arc having a first origin $O_1$ and a constant first radius $R_1$. The smaller diameter portion 58 is defined by a curved second edge 60 that is shaped as a second major arc having a second origin $O_2$ and a constant second radius $R_2$. The first radius $R_1$ is larger than the second radius $R_2$ (i.e., $R_1>R_2$). The first and second origins $O_1$, $O_2$ are spaced apart from one another by a distance Z that is measured along a direction of the rows R, i.e., along a direction between the first and third sides 26, 34. In the illustrated embodiment, the distance Z is greater than the first radius $R_1$ (i.e., $Z>R_1$) and is greater than the second radius $R_2$ (i.e., $Z>R_2$). In other embodiments, the distance Z can be approximately equal to the first radius $R_1$ (i.e., $Z=R_1$), or the distance Z can be approximately equal to the second radius $R_2$ (i.e., $Z=R_2$). In other embodiments, the distance Z can be greater than or equal to half of the second radius $R_2$ (i.e., $Z\geq R_2$) and less than or equal to a sum of the first and second radii $R_1$, $R_2$ (i.e., $Z\leq(R_1+R_2)$). The apertures 50 further include transition points 62 located where the first and second edges 59, 60 meet on each side of the aperture 50.

The first diameter $D_1$ of the larger diameter portion 54 is larger than the ring diameter 102. As such, when the sheet 22 is coupled to the bottle 14, the larger diameter portion 54 of the aperture 50 can freely receive the support ring 96 without the curved first edge 59 impinging against the support ring 96. In some embodiments, the first diameter $D_1$ can also be larger than the cap diameter 105 (FIG. 12) so that the cap 103 can also pass freely through the larger diameter portion 54. The second diameter $D_2$, however, is smaller than the ring diameter 102. As such, when the neck 90 is slid into the smaller diameter portion 58, the curved second edge 60 may abut against the support ring 96 and against the bell 94. The bottle 14, therefore, is prevented from moving out of the smaller diameter portion 58 along an axial direction of the bottle 14 (i.e., in a direction normal to the general extent of the sheet 22.

Figure 5:
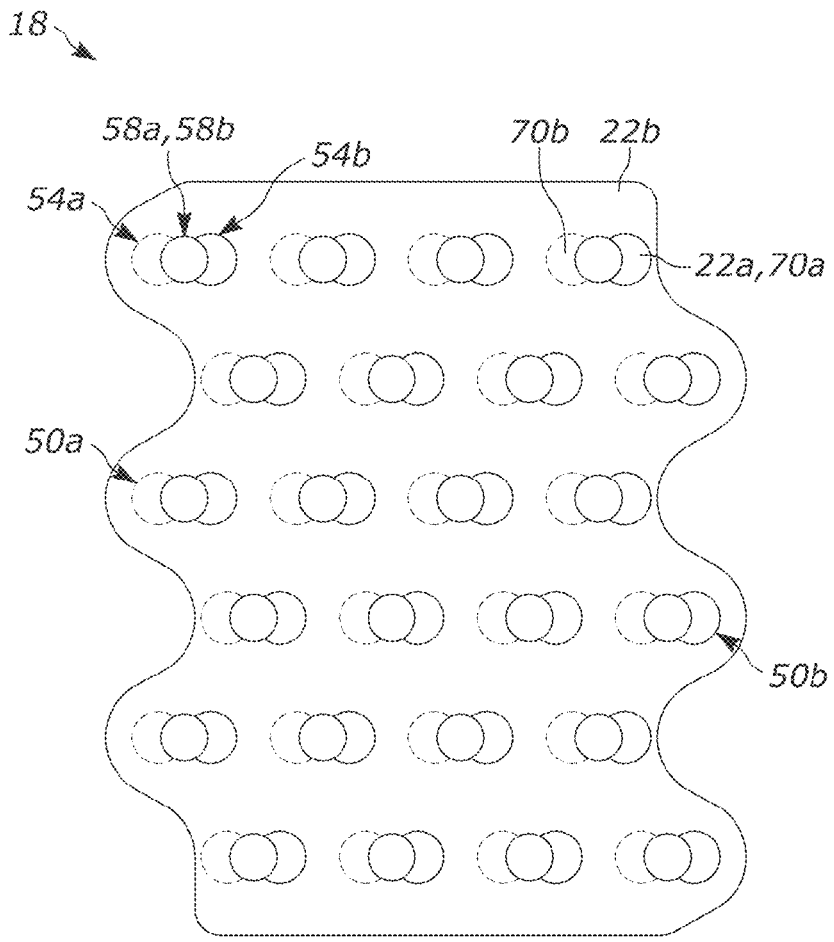
FIG. 5 is a top view of the first sheet of FIG. 3 coupled to a second sheet of the clip assembly.

FIG. 5 illustrates the clip assembly 18 having one top sheet 22*b* coupled (e.g., via adhesive, tape, external clips, etc.) to one bottom sheet 22*a*. The top sheet 22*b* is aligned with the bottom sheet 22*a* with respect to its outer perimeter. In other words, a perimeter of the top sheet 22*b* is aligned with a perimeter of the bottom sheet 22*a*. The apertures 50*b* of the top sheet 22*b* overlap with the apertures 50*a* of the bottom sheet 22*a*, such that the smaller diameter portions 58*b* of the top sheet 22*b* and the smaller diameter portions 58*a* of the bottom sheet 22*a* are aligned. As such, the bottles 14 are configured to extend through the small diameter portions 58*a*, 58*b* and be secured within the bottle pack 10. The larger diameter portions 54*b* of the top sheet 22*b* overlap with the bottom sheet 22*a* to define bottom removal portions 70*a*. Similarly, the larger diameter portions 54*a* of the bottom sheet 22*a* overlap with the top sheet 22*b* to define top removal portions 70*b*. An outline of the top removal portions 70*b* are illustrated. The illustrated removal portions 70*a*, 70*b* are weak points in the clip assembly 18, as the removal portions 70*a*, 70*b* include just one of the sheets 22*a*, 22*b*.

Figure 6:
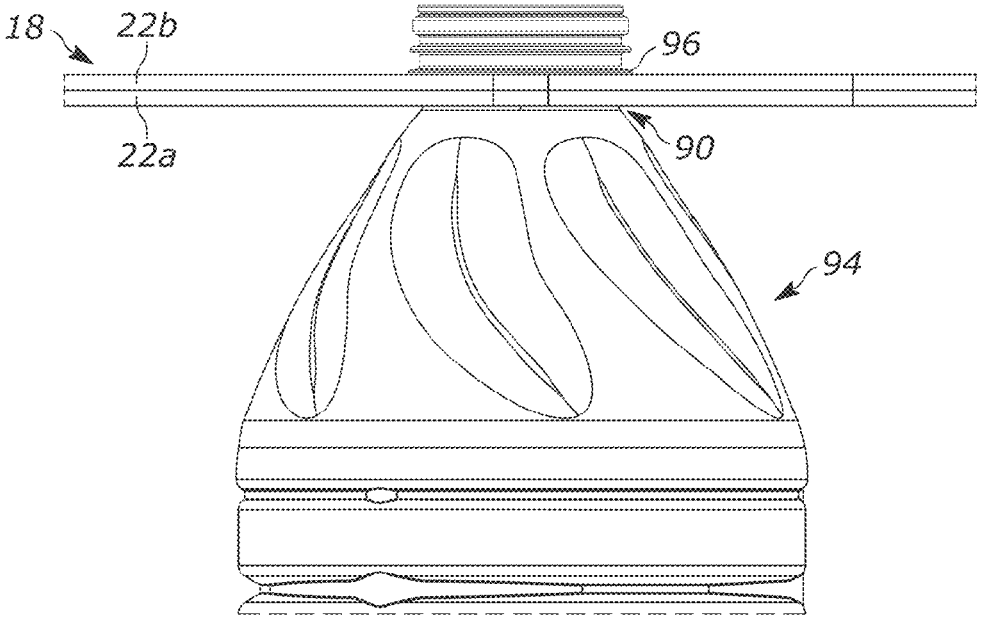
FIG. 6 is an enlarged view of the bottle pack of FIG. 1.

With reference to FIG. 6, the clip assembly 18 is disposed between the bell 94 and the support ring 96. The smaller diameter portions 58*a*, 58*b* (FIG. 5) of the bottom and top sheets 22*a*, 22*b* have a diameter greater than the neck diameter 98, but smaller than both the bell diameter 100 and the ring diameter 102. As such, the clip assembly 18 is secured between the bell 94 and the support ring 96.

Referring again to FIG. 1, the bottle pack 10 can further include a band 82 wrapped around the bottles 14. The band 82 is configured to provide support to the bottles 14, to hold the bottles 14 together in the bottle pack 10. The illustrated band 82 is formed from a plastic with an adhesive (e.g., tape), which has a width 84 significantly smaller than a height 16 (FIG. 2) of the bottles 14. In other embodiments, the band 82 may be made with a non-stick material, and/or can be made from the same material as the sheet 22 (e.g., cardboard, fiberboard, or the like). In yet other embodiments, the band 82 may be made with a fiber reinforced material. In other embodiments, the band 82 may have a width 84 similar to the height 16 of the bottles 14.

Figure 7:
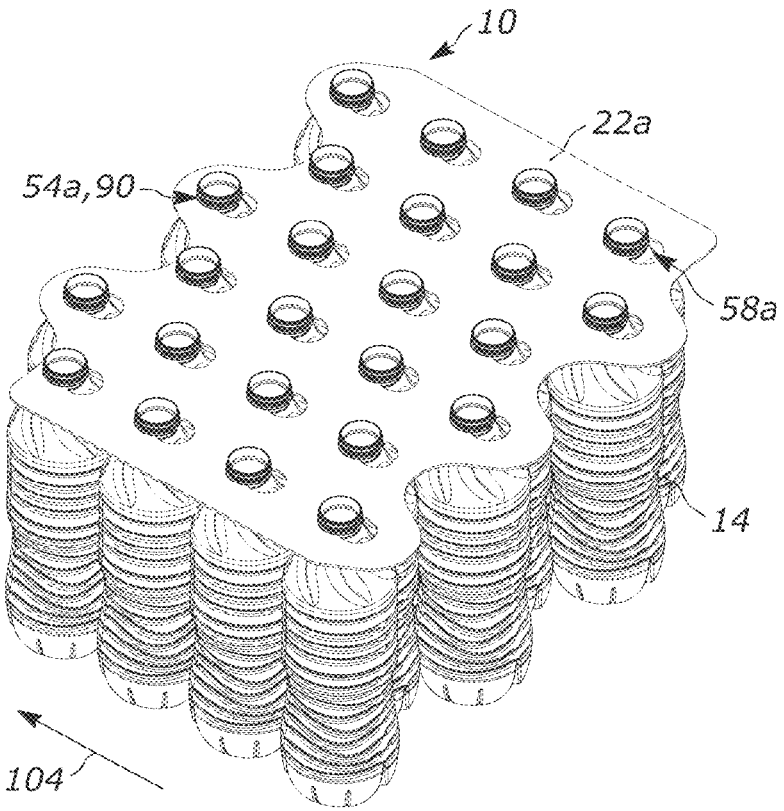
FIG. 7 is a perspective view of the bottle pack of FIG. 1 in a partially assembled state.
Figure 8:
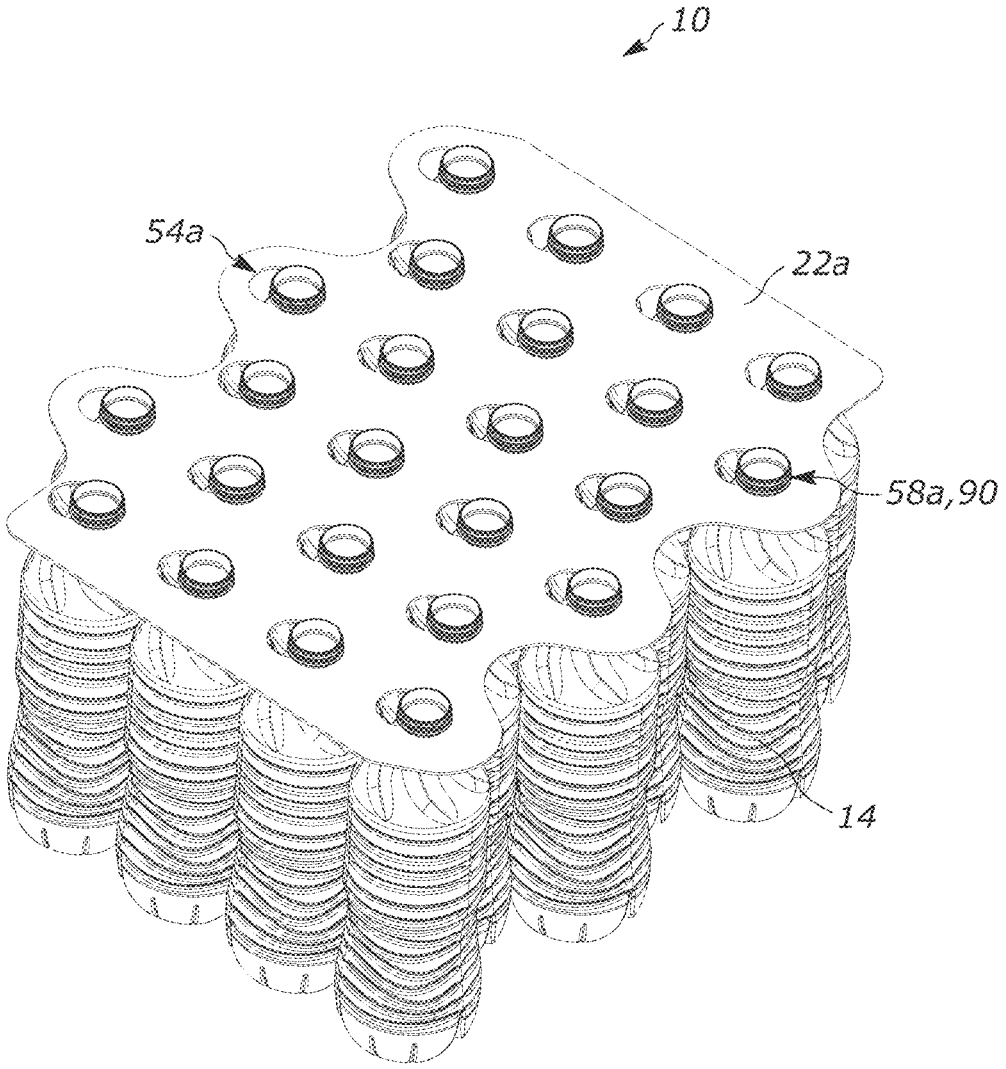
FIG. 8 is another perspective view of the bottle pack of FIG. 1 in a partially assembled state.
Figure 9:
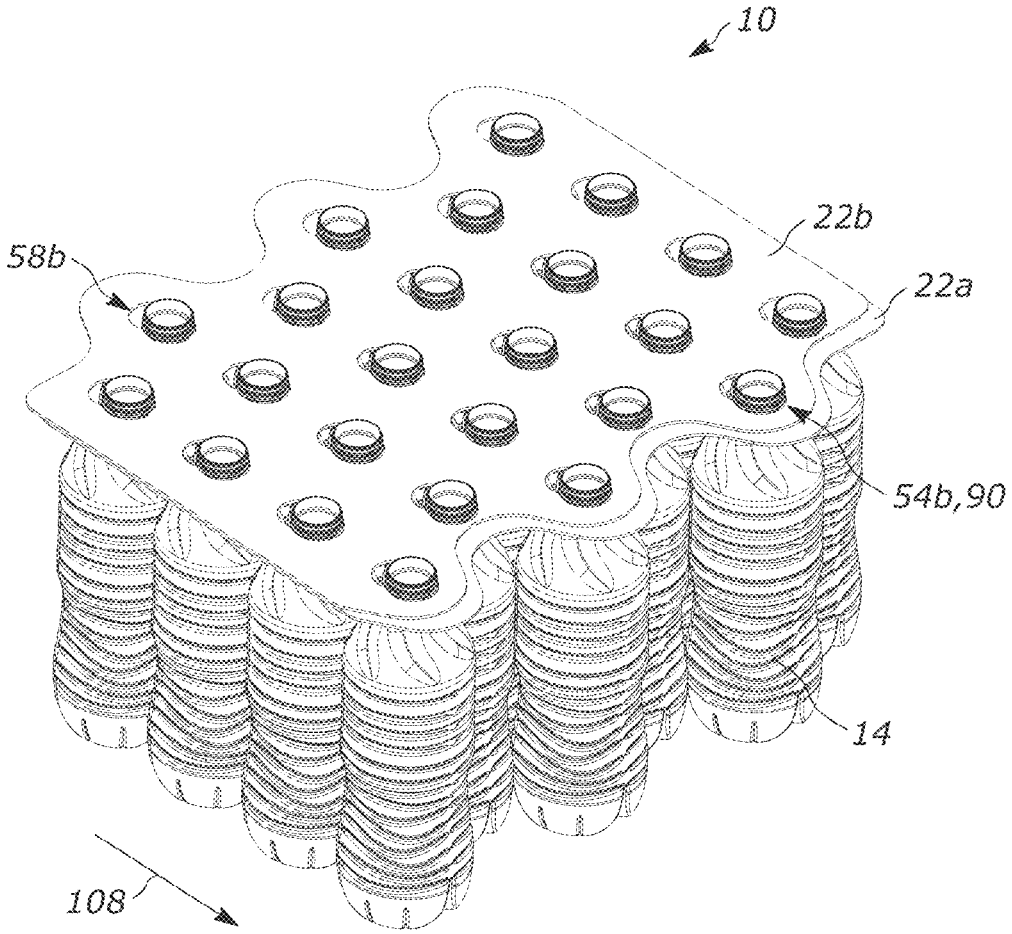
FIG. 9 is another perspective view of the bottle pack of FIG. 1 in a partially assembled state.

FIGS. 1 and 7-9 illustrate the assembly of the bottle pack 10. As illustrated in FIG. 7, the bottles 14 are first aligned in a desired arrangement (e.g., six staggered rows of four). The bottom sheet 22*a* is then placed on the bottles 14, such that the larger diameter portions 54*a* of the bottom sheet 22*a* receive the necks 90 of the bottles 14. The bottom sheet 22*a* is then moved in a first direction 104, such that the necks 90 of the bottles 14 are received in the smaller diameter portions 58*a* of the bottom sheet 22*a*, as illustrated in FIG. 8. As illustrated in FIG. 9, the top sheet 22*b* is then placed on top of the bottom sheet 22*a*, such that the larger diameter portions 54*b* of the top sheet 22*b* receive the necks 90 of the bottles 14. The top sheet 22*b* is then moved in a second direction 108 opposite the first direction 104, such that the necks 90 of the bottles 14 are received in the smaller diameter portions 58*b* of the top sheet 22*b*, as illustrated in FIG. 1. At this point, the bottom and top sheets 22*a*, 22*b* are aligned with each other. Stated another way, when viewing the bottle pack 10 from the top, the bottom sheet 22*a* is only visible through the larger diameter portions 54*b* of the top sheet 22*b* (shown in FIG. 5). A top surface of the bottom sheet 22*a*, a bottom surface of the top sheet 22*b*, or both may have a securing mechanism (e.g., adhesive, tape, external clips, etc.), which couples the bottom and top sheets 22*a*, 22*b* together. In the illustrated embodiment, the bottom and top sheets 22*a*, 22*b* are secured to one another via an adhesive such as glue applied between the top and bottom surfaces of the bottom and top sheets 22*a*, 22*b*. In other embodiments, the sheets 22*a*, 22*b* can be secured together via alternative means, such as, e.g., tape, separate couplers such as clips, fasteners, etc., or by integral features of the sheets 22*a*, 22*b* themselves. For example, the sheets 22*a*, 22*b* may each be formed with one or more interlocking features (e.g., folds, raised edges, interlocking recesses and protrusions, and the like) in corresponding relationship with one another such that the interlocking features engage one another to secure the sheets 22*a*, 22*b* together in assembly.

In embodiments including the band 82, the band 82 may be applied around the bottles 14 at any point of the assembly. In a preferred embodiment, the band 82 is applied around the bottles 14 before the bottom sheet 22*a* is placed on the bottles 14.

During operation, if the bottle pack 10 includes the band 82, a user may first remove the band 82. The user may then grasp one of the bottles 14 and pull the bottle 14 in a direction away from the clip assembly 18. As the user pulls the bottle 14, the support ring 96 may break (e.g., rip, tear, etc.) through the bottom removal portion 70*a*, the top removal portion 70*b*, or both, such that the bottle 14 is removed from the bottle pack 10. When all the bottles 14 are removed from the bottle pack 10, the user may dispose of (e.g., recycle) the clip assembly 18.

In other embodiments, the clip assembly 18 may include one sheet 22 and an additional holding mechanism (not shown). The holding mechanism may be configured to secure the bottles 14 within the smaller diameter portion 58 of the aperture 50. The holding mechanism can be formed as a plurality of plugs arranged to occupy the larger diameter portions 54 so as to hold the bottles 14 within the smaller diameter portions 58. As such, a removal portion may be defined by the additional holding mechanism covering the larger diameter portion 54.

Figure 10:
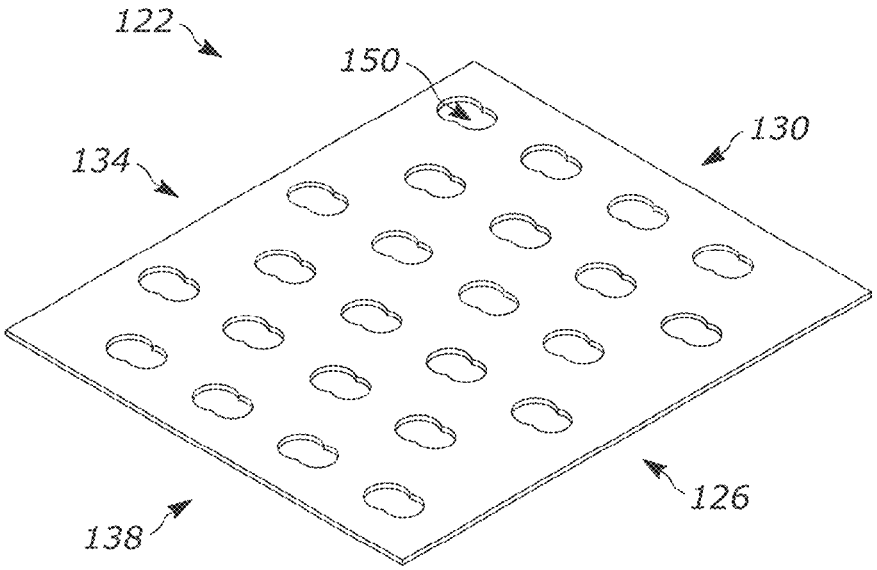
FIG. 10 is a perspective view of another embodiment of a sheet for use in the clip assembly of FIG. 1.

FIG. 10 illustrates another embodiment of a sheet 122 for use in the clip assembly 18. The sheet 122 includes first, second, third, and fourth sides 126, 130, 134, 138, which are all flat. As such, the sheet 122 is generally rectangular in shape. The sheet 122 includes a plurality of apertures 150 similar to the apertures 50 in the sheet 22.

Figure 11:
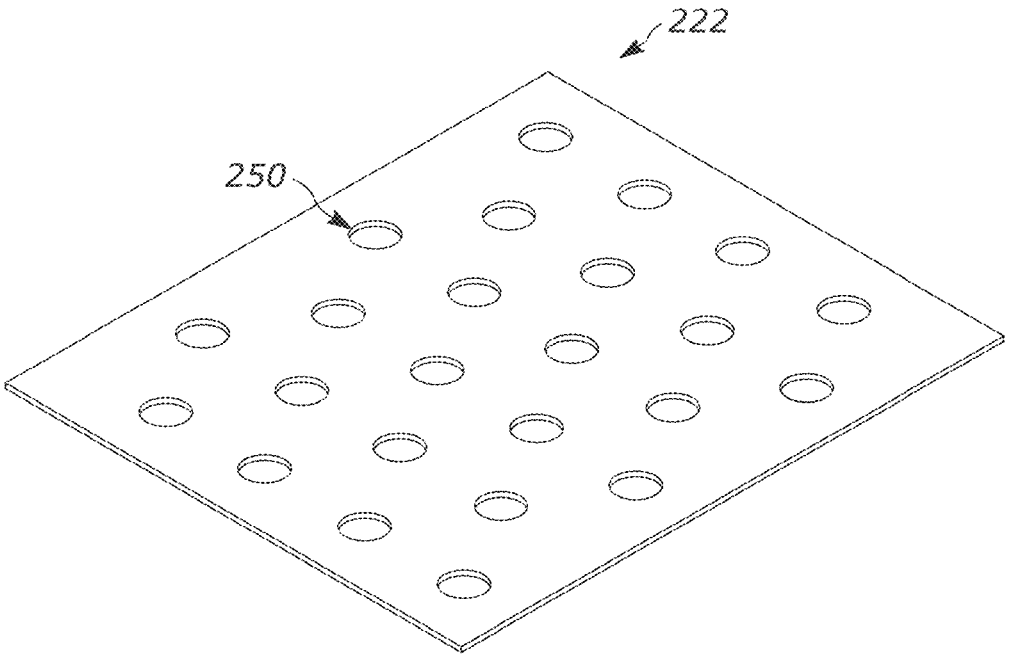
FIG. 11 is a perspective view of another embodiment of a sheet for use in the clip assembly of FIG. 1.

FIG. 11 illustrates another embodiment of a sheet 222 for use in the clip assembly 18. The sheet 222 includes a plurality of apertures 250, which are circular. The apertures 250 are sized similar to the larger diameter portions 54 of the sheet 22, such that the apertures 250 may receive the bottles 14.

Figure 12:
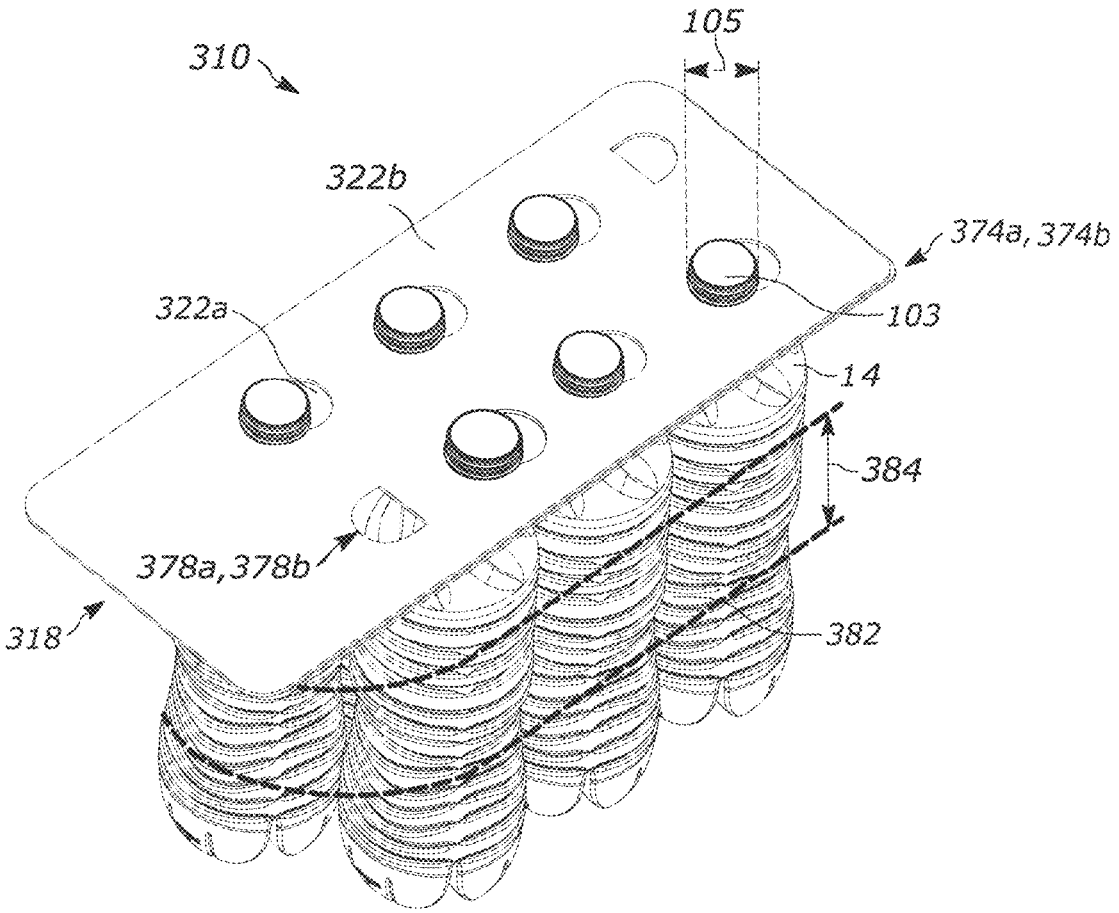
FIG. 12 is a perspective view of another bottle pack including a plurality of bottles and a clip assembly.

FIG. 12 illustrates another embodiment of a bottle pack 310 including a clip assembly 318 and the bottles 14. The illustrated bottle pack 310 includes six bottles 14. The clip assembly 318 includes generally rectangular bottom and top sheets 322*a*, 322*b*, each of which has rounded edges 374*a*, 374*b*. The sheets 322*a*, 322*b* further include additional apertures 378*a*, 378*b*, which are aligned when the sheets 322*a*, 322*b* are fully assembled. The additional apertures 378*a*, 378*b* may be grasped by a user to carry the bottle pack 10. In some embodiments, a handle may be coupled to the additional apertures 378*a*, 378*b*, such that a user may carry the bottle pack 10 by the handle. In other embodiments, the additional apertures 378*a*, 378*b* may be configured to eliminate material on the clip assembly 18. The bottle pack 310 further includes a band 382 wrapped around the bottles 14. The band 382 is configured to provide support to the bottles 14, to hold the bottles 14 together in the bottle pack 10. The illustrated band 382 is formed from a plastic with an adhesive (e.g., tape), which has a width 384 significantly smaller than a height 16 of the bottles 14 (FIG. 2). In other embodiments, the band 382 may be made with a non-stick material, and/or can be made from the same material as the sheet 22 (e.g., cardboard, fiberboard, or the like). In other embodiments, the band 382 may have a width 384 similar to the height 16 of the bottles 14.

Figure 13:
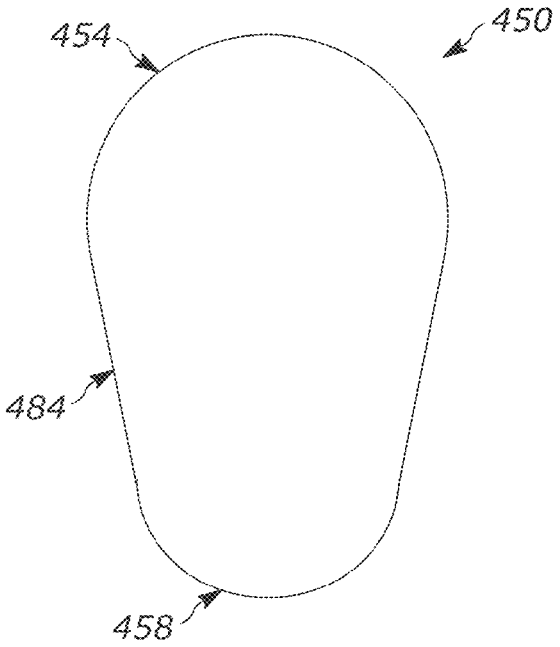
FIG. 13 is a top view of another aperture for use in the clip assembly of FIG. 1 or 12.

FIG. 13 illustrates another embodiment of an aperture 450 for use in the sheet 22, in which the aperture 450 resembles an elongated slot. The aperture 450 includes a larger diameter portion 454, a smaller diameter portion 458, and a transition portion 484 between the larger and smaller diameter portions 454, 458. The larger and smaller diameter portions 454, 458 are circular, and the transition portion 484 is linear, such that the diameter of the aperture 450 gradually changes in the transition portion 484. In some embodiments, the transition portion 484 may be non-linear or curved, such that the diameter of the aperture 450 does not uniformly change in the transition portion 484.

Figure 14:
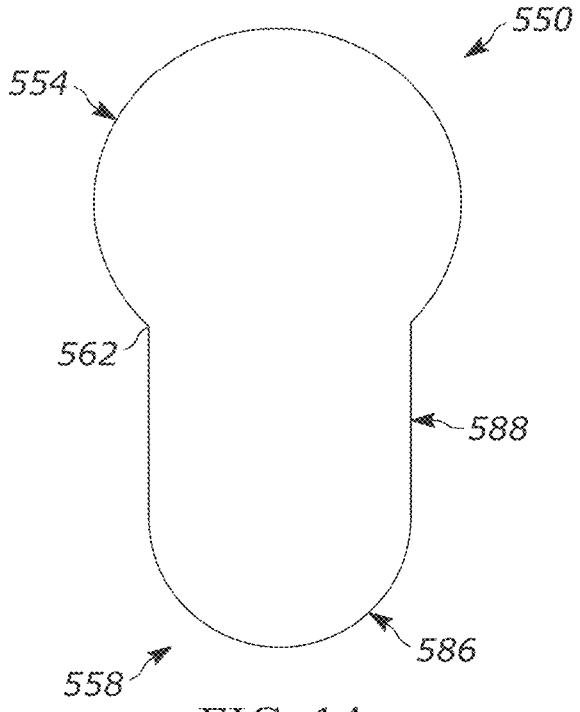
FIG. 14 is a top view of another aperture for use in the clip assembly of FIG. 1 or 12.

FIG. 14 illustrates another embodiment of an aperture 550 for use in the sheet 22, in which the aperture 550 resembles a keyhole. The aperture 550 includes a larger diameter portion 554, a smaller diameter portion 558, and transition points 562. The smaller diameter portion 558 includes a circular portion 586 and an elongate neck 588. The elongate neck 588 is between the transition points 562 and the circular portion 586. The illustrated elongate neck 588 and the circular portion 586 have the same diameter.

Figure 15:
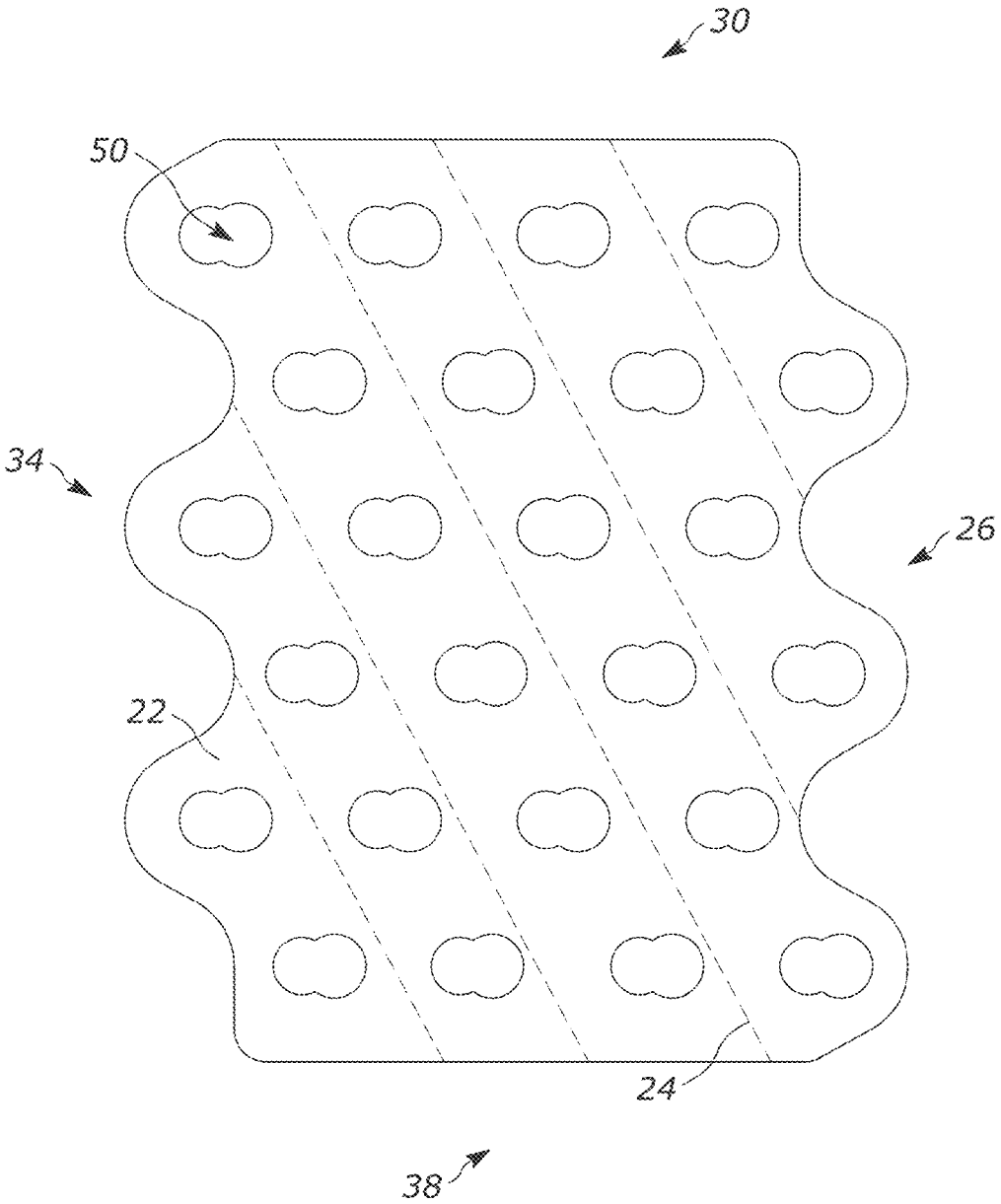
FIG. 15 is a top view of another embodiment of a sheet for use in the clip assembly of FIG. 1.
Figure 16:
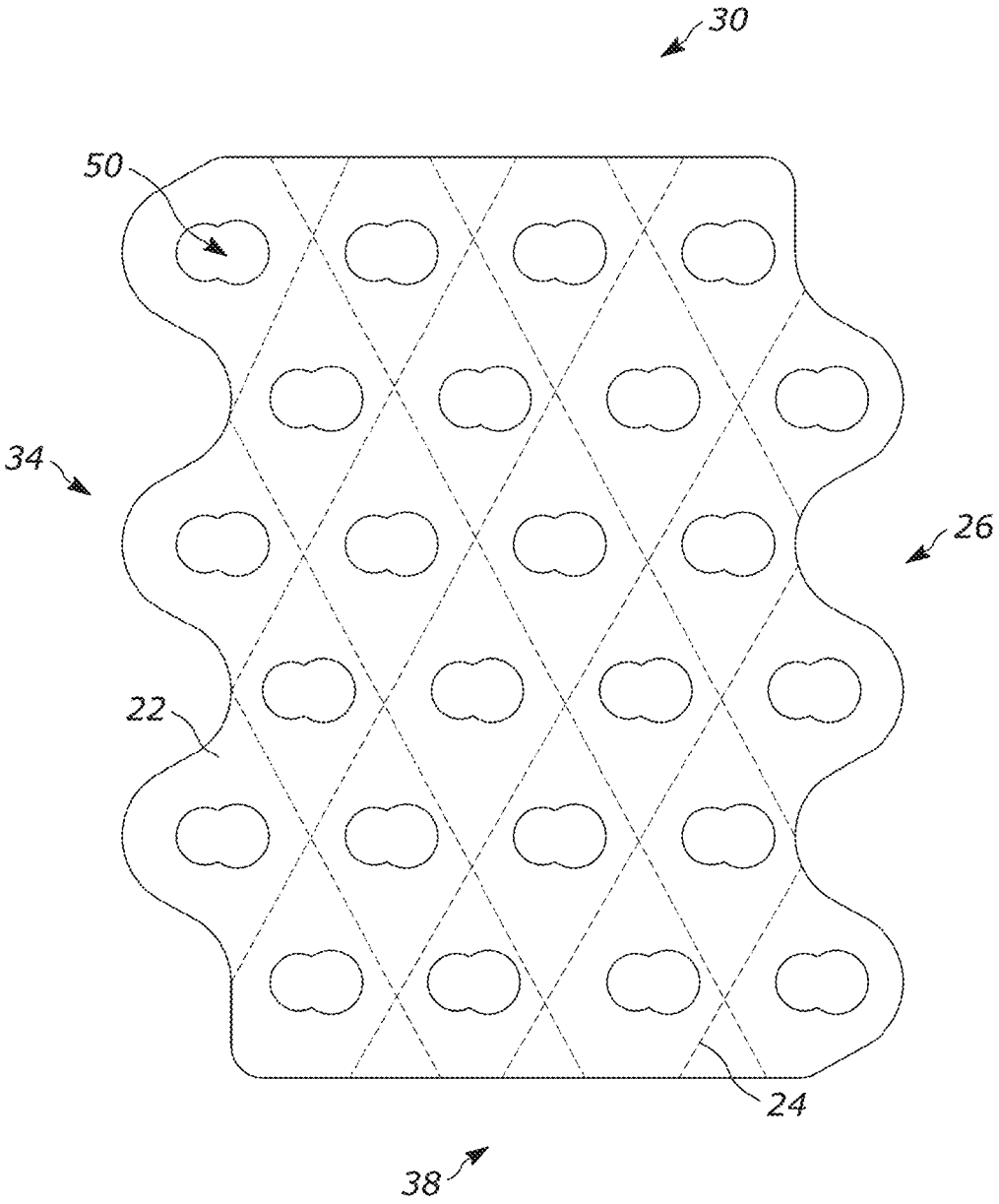
FIG. 16 is a top view of another embodiment of a sheet for use in the clip assembly of FIG. 1.

FIGS. 15 and 16 illustrate the strengthening features 24 of the sheet 22. The strengthening features 24 extend between adjacent apertures 50, such that the strengthening features 24 are equidistant from adjacent apertures 50 in the same row R (FIG. 3). The illustrated strengthening features 24 are oriented obliquely relative to the first and second sides 26, 30. In other embodiments, the strengthening features may be oriented parallel or perpendicular relative to the first or second sides 26, 30. In some embodiments, each of the strengthening features 24 may be parallel (FIG. 15). In other embodiments, some of the strengthening features 24 may be oriented obliquely relative to each other. In some embodiments, the strengthening features 24 can include flutes formed internally within the material of the sheet 22 (e.g., which can be made from cardboard, fiberboard, or the like). In other embodiments, the strengthening features can be formed as ridges formed in the sheet 22 and extending in the regions shown in FIGS. 15 and 16. In further embodiments, the strengthening features 24 may include elongated rigid members formed separately from the sheet 22 (e.g., made from cardboard, wood, plastic, or the like) and coupled thereto (e.g., via adhesive).

Figure 17:
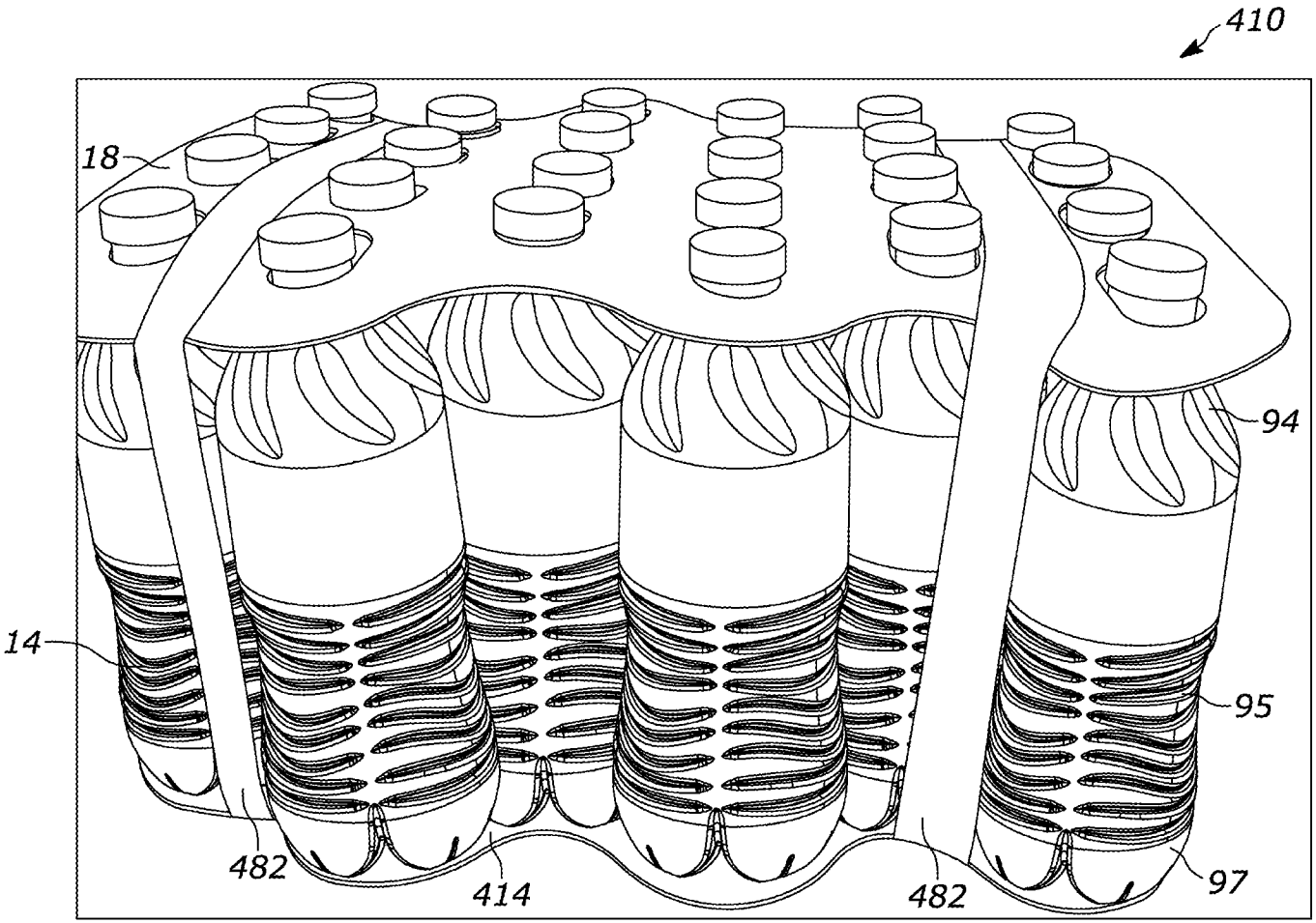
FIG. 17 is a perspective view of another bottle pack including a plurality of bottles, a clip assembly, and a bottom sheet.
Figure 19:
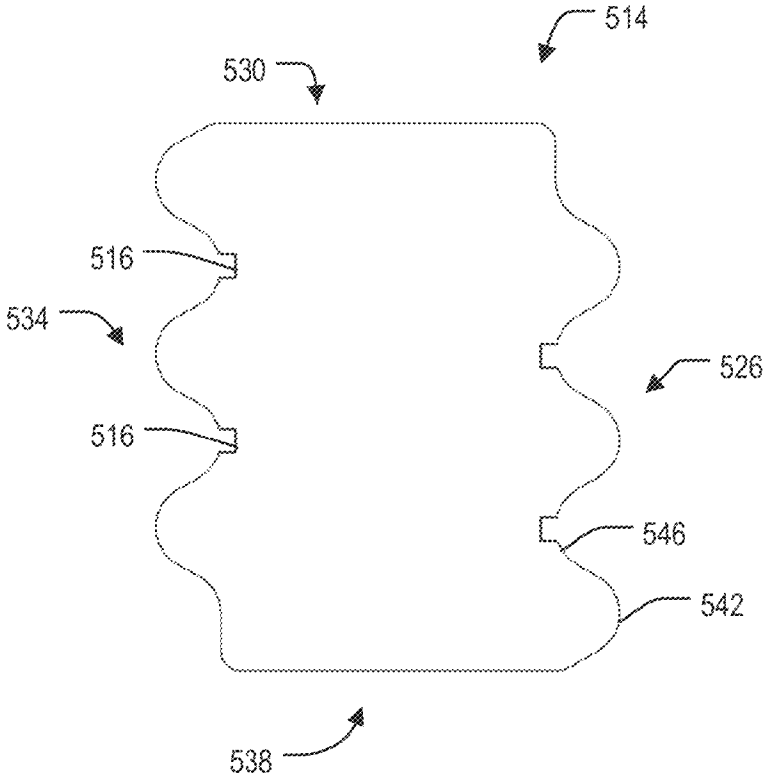
FIG. 19 is a top view of another embodiment of a bottom sheet for use in the bottle pack of FIG. 17.

FIG. 17 illustrates another embodiment of a bottle pack 410 including the clip assembly 18, the bottles 14, and a base sheet 414. The illustrated bottle pack 410 includes the same number of bottles 14 as the bottle pack 10. The base sheet 414 is in contact with a base 97 of each bottle 14 and further retains the bottles 14 in the bottle pack 410. The base 97 is positioned on an opposite side of the sidewall 95 from the bell 94. The bottle pack 410 further includes a band 482 wrapped around the clip assembly 18 and the base sheet 414. The band 482 secures the bottles 14 between the clip assembly 18 and the base sheet 414. The illustrated bottle pack 410 includes two bands 482 spaced apart from each other. In other embodiments, the bottle pack 410 can include fewer or more bands 482 (e.g., one, three, etc.). Each illustrated band 482 may be formed from a non-plastic material (e.g., a recyclable material, such as cardboard, fiberboard, or other fiber-based materials. In some embodiments, the band 484 can further include an adhesive (e.g., glue) that secures the band 484 to the clip assembly 18 and/or to the base sheet 414. In other embodiments, each band 482 may be made with a non-stick material, and/or can be made from the same material as the top or bottom sheets 22*a*, 22*b* (e.g., cardboard, fiberboard, or the like). In yet other embodiments, each band 482 may be made with a fiber reinforced material. Each illustrated band 482 has a width of 5 millimeters. In other embodiments, each band 482 can have a width greater or less than 5 millimeters. In some embodiments, the base 97 of each bottle 14 can be coupled to the bottom sheet 414. The bases 97 can be coupled to the base sheet 414 by, for example, an adhesive.

Figure 18:
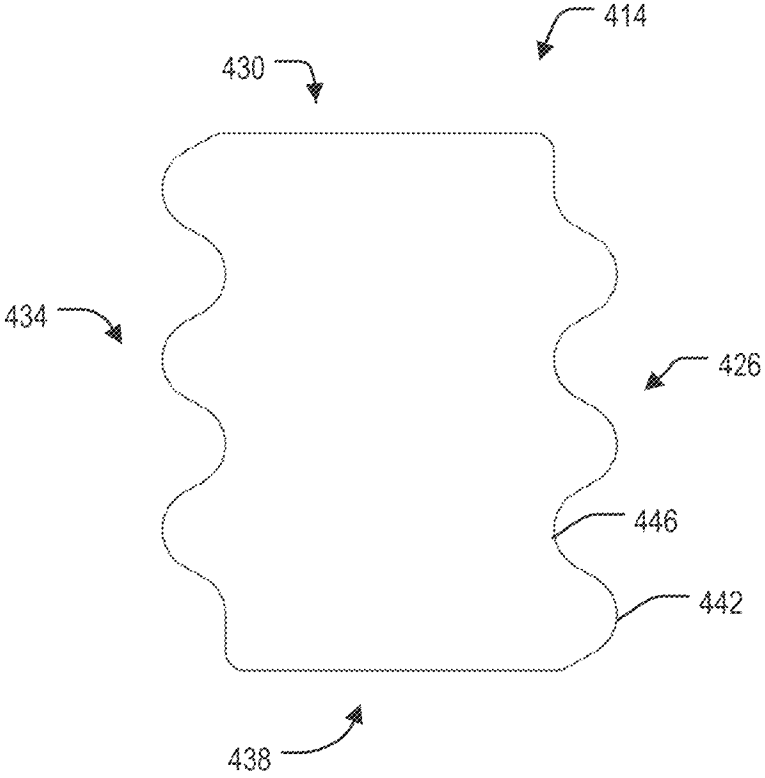
FIG. 18 is a top view of the bottom sheet of FIG. 17.

With reference to FIG. 18, the base sheet 414 includes a first side 426, a second side 430, a third side 434 opposite the first side 426, and a fourth side 438 opposite the second side 430. The illustrated first and third sides 426, 434 include undulations, which define an alternating series of extended portions 442 and recessed portions 446. The illustrated second and fourth sides 430, 438 are generally flat or straight. The illustrated base sheet 414 has a perimeter shape identical to the perimeter shapes of the top and bottom sheets 22*a*, 22*b*, but does not include any interior apertures. As such, the alternating series of extended and recessed portions 442, 446 are aligned with the alternating series of extended and recessed portions 42, 46 with the bottle pack 410 assembled. In other embodiments, the base sheet 414 can have a different shape than the top sheet 22*a* and/or the bottom sheet 22*b*.

With returned reference to FIG. 17, each band 482 extends between adjacent rows R of the bottles 14. Stated another way, each band 482 extends generally parallel with the rows R of bottles 14. In some embodiments, each band 482 can extend obliquely relative to the rows R. For example, each band 482 can extend from one recessed portion 446 on the first side 426 to one recessed portion 446 on the third side 434. In some embodiments, each band 482 can also function as a handle. The band 482 can form a loop or a strap that extents from the bottle pack 410 and can be grasped by a user to carry the bottle pack 410. For example, each band 482 can double over itself or overlap for a portion (e.g., adjacent the clip assembly 18) of the band 482. The band 482 can overlap by, for example, four inches.

FIG. 18 illustrates another embodiment of a base sheet 514 for use in the bottle pack 410. The base sheet 514 includes a first side 526, a second side 530, a third side 534 opposite the first side 526, and a fourth side 538 opposite the second side 530. The illustrated first and third sides 526, 534 include undulations, which define an alternating series of extended portions 542 and recessed portions 546. The illustrated second and fourth sides 530, 538 are generally flat or straight. The base sheet 514 includes a plurality of notches 516 in the first and third sides 526, 534. More specifically, the base sheet 514 includes notches 516 in at least some of the recessed portions 546. In other embodiments, the notches 516 can be located on different portions of the first and third sides 526, 534. In yet other embodiments, the notches 516 can be located on the second and fourth sides 530, 538. The notches 516 receive the bands 482 to further secure the bands 482 to the bottle pack 410. Stated another way, the notches 516 prevent the bands 482 from sliding along the edges of the base sheet 514 and/or the clip assembly 18. In some embodiments, the clip assembly 18 can include notches similar to the notches 516. In these embodiments, the bands 482 are received in the notches 516 in the base sheet 514 and the notches in the clip assembly 18. Each notch 516 can define a width approximately equal to the width of the corresponding band 482 received therein.

Although the disclosure has been described in detail with reference to certain preferred embodiments, variations and modifications exist within the scope and spirit of one or more independent aspects of the disclosure as described.

Various features and advantages of the disclosure are set forth in the following claims.

What is claimed is:

1. A clip assembly for holding a bottle in a bottle pack, the clip assembly comprising:

a first sheet defining a first plurality of apertures, each aperture of the first plurality of apertures having a larger diameter portion and a smaller diameter portion;

a second sheet defining a second plurality of apertures, each aperture of the second plurality of apertures having a larger diameter portion and a smaller diameter portion; and an adhesive positioned between a top surface of the first sheet and a bottom surface of the second sheet, the adhesive to secure the first sheet to the second sheet, wherein the clip assembly is configured such that when the top surface of the first sheet and the bottom surface of the second sheet are adjacent and the smaller diameter portion of an aperture of the first plurality of apertures aligns with the smaller diameter portion of an aperture of the second plurality of apertures, the larger diameter portion of the aperture of the first plurality of apertures and the larger diameter portion of the aperture of the second plurality of apertures are on opposing sides of the aligned smaller diameter portions.

2. The clip assembly of claim 1, wherein the second sheet is identical to the first sheet.

3. The clip assembly of claim 1, wherein the first sheet and the second sheet are made of one of cardboard or fiberboard.

4. The clip assembly of claim 1, wherein the larger diameter portions of the apertures of the first plurality of apertures and of the second plurality of apertures are circular, and wherein the smaller diameter portions of the apertures of the first plurality of apertures and of the second plurality of apertures are circular.

5. The clip assembly of claim 1, wherein the first plurality of apertures is arranged in a plurality of first rows, the second plurality of apertures is arranged in a plurality of second rows, adjacent first rows of the plurality of first rows are offset from each other, and adjacent second rows of the plurality of second rows are offset from each other.

6. The clip assembly of claim 1, wherein each of the first and second sheets includes strengthening features in the form of ridges to improve rigidity of the first and second sheets.

7. The clip assembly of claim 1, further comprising a band configured to wrap around the plurality of bottles.

8. The clip assembly of claim 5, wherein:

a side of the first sheet includes a plurality of extended portions and a plurality of recessed portions, the extended portions and the recessed portions alternating along a length of the side of the first sheet, a side of the second sheet includes a plurality of extended portions and a plurality of recessed portions, the extended portions and the recessed portions alternating along a length of the side of the second sheet, the plurality of first rows are correspondingly aligned with the plurality of extended portions and the plurality of recessed portions of the first sheet, and the plurality of second rows are correspondingly aligned with the plurality of extended portions and the plurality of recessed portions of the second sheet.

9. The clip assembly of claim 8, wherein each extended portion of the first sheet is aligned with a corresponding extended portion of the second sheet, and each recessed portion of the first sheet is aligned with a corresponding recessed portion of the second sheet.

10. The bottle pack of claim 7, wherein the clip assembly and the band are made of a same material.

11. A bottle pack comprising:

a plurality of bottles, each bottle including a neck defining a first diameter, a bell defining a second diameter, and a support ring defining a third diameter, the first diameter being smaller than the second diameter and the third diameter; and a clip assembly according to claim 1 wherein a bottle of the plurality of bottles extends through the smaller diameter portion of an aperture of the first plurality of apertures of the first sheet and the smaller diameter portion of an aperture of the second plurality of apertures of the second sheet and is captured between the first sheet and the second sheet, and wherein the clip assembly is configured to hold each bottle of the plurality of bottles.

* * * * *